US007188786B2

(12) United States Patent
Dodd

(10) Patent No.: US 7,188,786 B2
(45) Date of Patent: Mar. 13, 2007

(54) HOSE-END SPRAYER ASSEMBLY

(75) Inventor: Joseph K. Dodd, Grandview, MO (US)

(73) Assignee: MeadWestvaco Corporation, Glen Allen, VA (US)

( * ) Notice: Subject to any disclaimer, the term of this patent is extended or adjusted under 35 U.S.C. 154(b) by 301 days.

(21) Appl. No.: 10/974,708

(22) Filed: Oct. 28, 2004

(65) Prior Publication Data

US 2006/0097073 A1 May 11, 2006

(51) Int. Cl.
*A62C 5/02* (2006.01)

(52) U.S. Cl. ..... 239/310; 239/318; 239/581.1; 239/347; 222/630; 222/637

(58) Field of Classification Search ..... 239/310, 239/318, 407, 581.1, 413, 414, 354, 347, 239/348, 581.2, 424, 400; 222/630, 637, 222/133, 132, 130
See application file for complete search history.

(56) References Cited

U.S. PATENT DOCUMENTS

| | | | | | |
|---|---|---|---|---|---|
| 1,071,432 | A | | 8/1913 | Kelley | |
| 2,612,403 | A | | 9/1952 | Burch | 239/318 |
| 2,761,734 | A | | 9/1956 | Farmer | 239/318 |
| 3,034,731 | A | * | 5/1962 | Chapin | 239/318 |
| 3,186,643 | A | * | 6/1965 | George et al. | 239/318 |
| 3,201,049 | A | | 8/1965 | Hayes | 239/433 |
| 3,204,875 | A | | 9/1965 | Langstroth | 239/433 |
| 3,212,716 | A | | 10/1965 | Mills et al. | 239/318 |
| 3,255,972 | A | | 6/1966 | Hultgren et al. | 239/433 |
| 3,333,601 | A | | 8/1967 | Lofgreen | |
| 3,610,535 | A | | 10/1971 | Bradshaw | |
| 3,764,074 | A | * | 10/1973 | James | 239/318 |
| 3,770,205 | A | * | 11/1973 | Proctor et al. | 239/317 |
| 3,940,069 | A | * | 2/1976 | Gunzel et al. | 239/318 |
| 3,964,689 | A | | 6/1976 | Horvath, Jr. et al. | 239/433 |
| 4,033,509 | A | * | 7/1977 | Sheets | 239/226 |
| 4,057,940 | A | * | 11/1977 | Wemmer | 451/101 |
| 4,171,070 | A | | 10/1979 | Colgate et al. | 222/133 |
| 4,315,601 | A | | 2/1982 | Brooker | 239/142 |
| 4,349,157 | A | * | 9/1982 | Beiswenger et al. | 239/509 |
| 4,369,921 | A | * | 1/1983 | Beiswenger et al. | 239/317 |
| 4,475,689 | A | | 10/1984 | Hauger et al. | 239/318 |
| 4,508,272 | A | | 4/1985 | Thompson | 239/318 |
| 4,527,740 | A | | 7/1985 | Gunzel, Jr. et al. | 239/318 |
| 4,595,127 | A | | 6/1986 | Stoody | 222/135 |
| 4,600,130 | A | * | 7/1986 | Libit | 222/209 |
| D284,988 | S | * | 8/1986 | Powell | D23/223 |
| 4,736,891 | A | | 4/1988 | Chow et al. | 239/318 |
| 4,750,674 | A | | 6/1988 | Chow et al. | 239/318 |
| 4,767,058 | A | * | 8/1988 | LaRosa et al. | 239/309 |
| 4,901,923 | A | * | 2/1990 | McRoskey et al. | 239/123 |
| 4,923,098 | A | * | 5/1990 | Schoonover et al. | 222/465.1 |

(Continued)

*Primary Examiner*—Kevin Shaver
*Assistant Examiner*—Trevor McGraw
(74) *Attorney, Agent, or Firm*—Gordon & Jacobson, PC

(57) ABSTRACT

A hose-end sprayer assembly connectable to at least one container of product to be dispensed has an elongated housing for a venturi tube assembly rotatable about its central axis and devised to selectively open and close a product inlet opening as well as its associated vent valve, an independently controllable liquid carrier valve being provided for opening and closing the carrier liquid flow through the venturi tube duct in the venturi tube assembly can be devised for opening and closing inlet product inlet openings of separately stored chemical products sequentially or simultaneously.

32 Claims, 7 Drawing Sheets

U.S. PATENT DOCUMENTS 5,007,588 A * 4/1991 Chow et al. ..... 239/318
5,039,016 A * 8/1991 Gunzel et al. ..... 239/314
5,100,059 A * 3/1992 Englhard et al. ..... 239/310
5,183,206 A * 2/1993 Gavin ..... 239/317
5,213,264 A 5/1993 Styne ..... 239/309
5,213,265 A * 5/1993 Englhard et al. ..... 239/310
5,320,288 A * 6/1994 Ketcham, Jr. ..... 239/316
5,356,076 A 10/1994 Bishop ..... 239/311
5,372,310 A * 12/1994 Ketcham ..... 239/317
5,375,769 A * 12/1994 Schultz ..... 239/310
5,383,603 A * 1/1995 Englhard et al. ..... 239/314
5,595,345 A * 1/1997 Chura et al. ..... 239/312
5,626,291 A 5/1997 Flinn et al. ..... 239/310
H1691 H * 11/1997 Ono et al. ..... 239/3
5,804,082 A * 9/1998 Lowery, Jr. ..... 210/800
5,853,114 A * 12/1998 Giovanoli ..... 222/479
5,881,955 A 3/1999 Styne ..... 239/310
5,944,259 A * 8/1999 Brown ..... 239/414
5,954,272 A * 9/1999 Liao ..... 239/317
5,954,273 A 9/1999 Ruta et al. ..... 239/419.3
5,957,387 A * 9/1999 Porta et al. ..... 239/312
6,012,650 A * 1/2000 Hadar ..... 239/317
6,053,374 A 4/2000 Santagiuliana ..... 222/534
6,068,204 A * 5/2000 Alexander ..... 239/310
6,102,308 A * 8/2000 Steingass et al. ..... 239/424.5
6,230,982 B1 * 5/2001 Newton ..... 239/10
6,240,983 B1 * 6/2001 Beldham et al. ..... 141/100
6,254,015 B1 * 7/2001 Abplanalp ..... 239/318
6,267,303 B1 7/2001 Francis ..... 239/318
6,283,385 B1 9/2001 Beaver et al.
6,345,773 B1 * 2/2002 Shanklin et al. ..... 239/318
6,371,385 B1 * 4/2002 Schiller et al. ..... 239/310
6,378,785 B1 * 4/2002 Dodd ..... 239/318
6,425,534 B2 * 7/2002 Ketcham et al. ..... 239/316
6,461,361 B1 * 10/2002 Epstein ..... 606/82
6,471,141 B2 * 10/2002 Smith et al. ..... 239/10
6,578,776 B1 * 6/2003 Shanklin et al. ..... 239/318
6,604,546 B1 * 8/2003 Gilmore ..... 137/550
6,672,520 B2 * 1/2004 Shanklin et al. ..... 239/318
6,708,901 B2 * 3/2004 Hubmann et al. ..... 239/310
6,749,133 B1 * 6/2004 Ketcham et al. ..... 239/318
6,752,297 B1 * 6/2004 Ische ..... 222/464.7
6,772,966 B2 * 8/2004 Foster et al. ..... 239/581.2
6,913,209 B2 * 7/2005 Shanklin et al. ..... 239/318
6,948,451 B2 * 9/2005 Bond et al. ..... 119/665
2003/0192964 A1 10/2003 Foster et al.
2005/0098656 A1 5/2005 Dodd ..... 239/318

* cited by examiner

PRODUCT A
PRODUCT B
C
30
32
33
34
35
36
37
38
39
41
42
44
47
48
49
51
52
53
54
55
56
57
58
59
63
64
65
66
67
67A
68
69
71
75
77
78

PRODUCT A
PRODUCT B

PRODUCT A
PRODUCT B
C 36
32
42
57
48
52
54
64
71
23
75
72
70
22
63
58
53
69
35
30
34
PRODUCT A
PRODUCT B
C 83
84

HOSE-END SPRAYER ASSEMBLY

BACKGROUND OF THE INVENTION

This invention relates generally to a sprayer connectable to at least one chemical product to be aspirated by and into the flow of a carrier liquid on connection of the sprayer to a source of the carrier liquid such as the end of a hose. More particularly, the invention relates to such a sprayer connectable to a pair of containers of disparate chemical products for selective discharge by the carrier liquid.

A number of hose-end sprayer assemblies have been developed for siphoning a chemical product from a container to which the assembly is attached, and discharging the siphoned chemical in diluted form by the carrier liquid delivered by the hose. U.S. Pat. No. 6,378,785, commonly owned herewith with, is exemplary of such a hose-end sprayer assembly which has a single valve for regulating the discharge between off, rinse, and spray positions.

While such a sprayer represents a marked improvement over prior aspiration-type sprayers connected to the end of the hose for garden, lawn and hard-surface applications, the sprayer is not readily adaptable for siphoning one or more products selectively to fit various needs and uses. For example, for hard-surface applications it would be desirable to adapt the sprayer assembly to optional operations without costly and complex redesign of the sprayer. For example, the sprayer should, with minor refitting, have the capability of aspirating a single chemical product, dual disparate chemical products alternatively, and dual disparate chemical products simultaneously.

SUMMARY OF THE INVENTION

A hose-end sprayer assembly is adapted for connection to at least one container of product to be dispensed, and includes a single venturi tube assembly rotatable about its longitudinal axis, the tube assembly being configured to block a liquid product inlet opening on a product container from a liquid duct defined by the tube assembly in a first rotative position of the assembly, and to connect the liquid product inlet opening with the liquid duct in a second rotative position of the assembly, the assembly being likewise configured to open and close a vent port for the container respectively in the second and the first rotative positions of the tube assembly. The sprayer assembly has an independently operable liquid carrier control valve for controlling the flow of carrier liquid through the liquid duct of the venturi tube assembly between on and off positions.

Then venturi tube assembly is configured to sequentially open and close the first and a second product inlet opening from a second liquid product container, and its associated vent port, and another embodiment of the venturi tube assembly is configured to simultaneously open and close the two product inlet openings.

The configuration of the venturi tube assembly of the hose-end sprayer according to the invention has external valving which may be in the form of external rings having cutouts and/or may be in the form of external pads for covering and uncovering the product inlet opening or openings and associated vent ports or port thereby rendering the hose-end sprayer assembly of the invention completely versatile and adaptable for a wide range of hose-end spraying operations. The venturi tube assembly functions as a rotary valve which can be formed of a single, elongated venturi tube and a surrounding diverter tube having a predetermined external configuration for opening and closing the product inlet opening or openings and associated vent port or ports. The diverter tube may be simply replaced and substituted by diverter tubes having different configurations to accommodate different sequences of operation of a single or double product hose-end spraying operation.

Other objects, advantages and novel features of the invention will become more apparent from the following detailed description of the invention when taken in conjunction with the accompanying drawings.

DETAILED DESCRIPTION OF THE INVENTION

Figure 14:
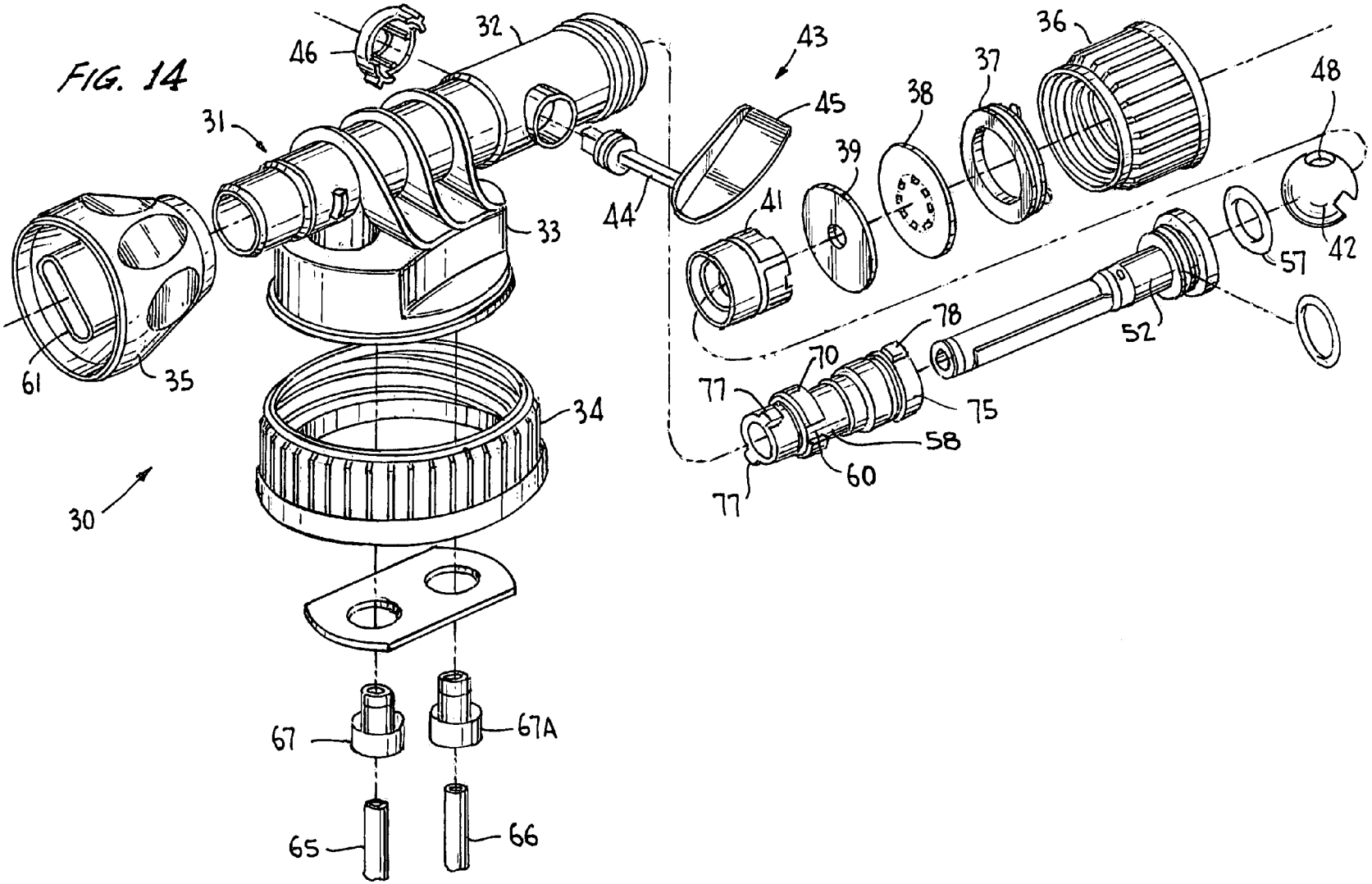
FIG. 14 is an expanded perspective view of the sprayer assembly of FIG. 1.
Figure 15:
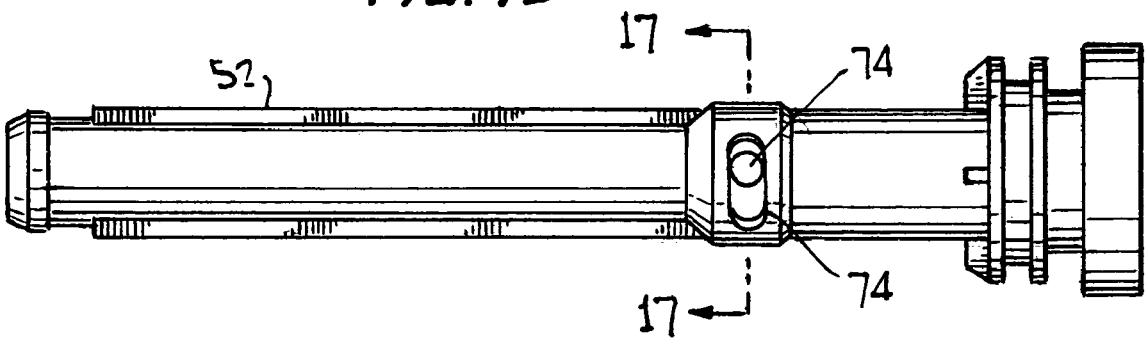
FIG. 15 is a side elevational view of the venturi tube which is part of the sprayer assembly according to the invention.
Figure 16:
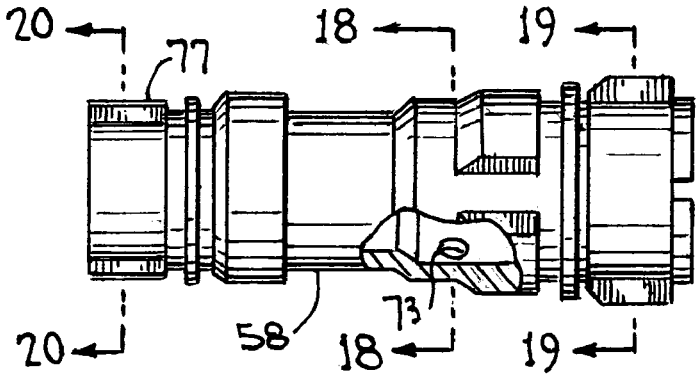
FIG. 16 is a side elevational view, partly broken away, of the diverter tube which surrounds the venturi tube and which together comprise the venturi tube assembly according to the invention.
Figure 17:
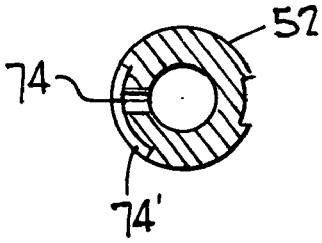
FIG. 17 is a sectional view taken substantially along the line 17—17 of FIG. 15.
Figure 18:
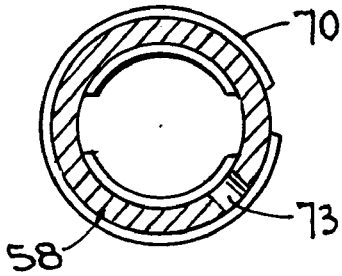
FIGS. 18, 19 and 20 are respectively sectional views taken substantially along the lines 18—18, 19—19 and 20—20 of FIG. 16.
Figure 19:
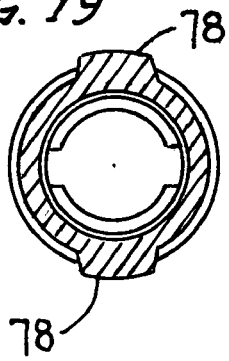
Figure 20:
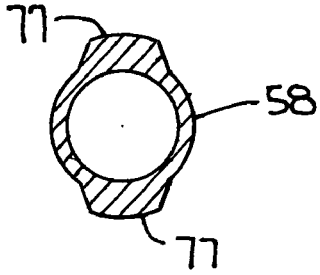

Turning now to the drawings wherein like reference characters refer to like and corresponding parts throughout the several views, the hose-end sprayer assembly according to the invention is generally designated 30 in FIGS. 1, 2, 4, 5, 10, 14 and 21. As best shown in FIG. 14, the sprayer assembly includes a sprayer housing 31 which includes a elongated tubular portion 32 having an integral or otherwise connected bottle mount 33 with which an internally threaded closure ring 34 is coupled to facilitate mounting the sprayer assembly to a container C (FIG. 4) of at least one product to be siphoned.

Figures 4, 4A:
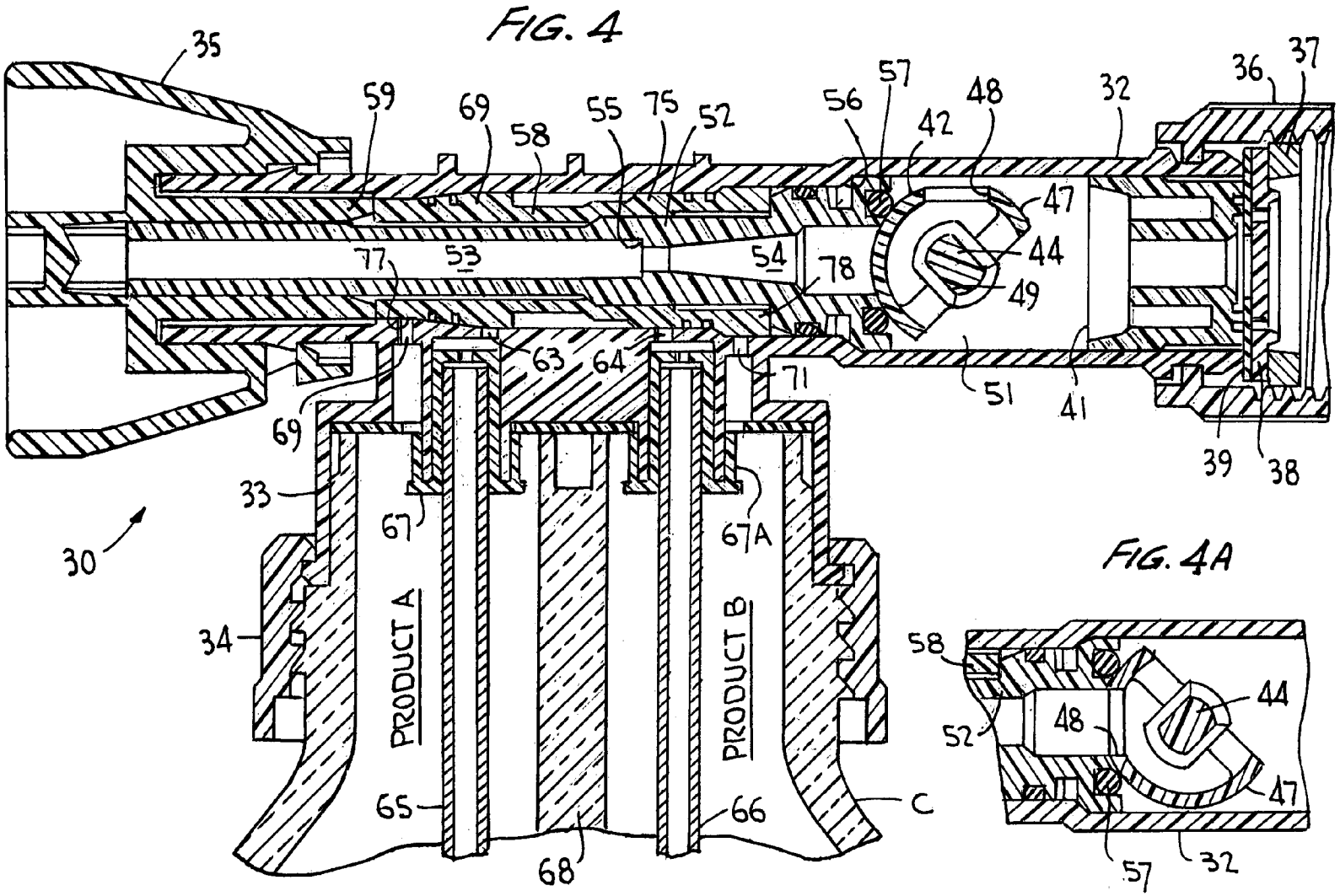
FIG. 4 a longitudinal sectional view of the sprayer assembly, at a slightly enlarged scale, taken substantially along the line 4—4 of FIG. 2, shown mounted on a dual chamber bottle, and showing the liquid carrier control valve rotated to an off position.
FIG. 4A is a partial view similar to FIG. 4 showing the liquid carrier control valve rotated to an open position.

An external member 35, which functions as a selector grip and which may be cup-shaped for easy manipulation by the operator, is coupled at the forward end of tubular portion 32 for free rotation in either direction about the central axis of portion 32. An internally threaded hose closure 36 is coupled to the opposite, rearward end of tubular portion 32 for mounting sprayer assembly 30 to the end of a garden hose (not shown) or the like. As shown in FIGS. 4 and 14, closure 36 contains a hose washer 37, an anti-siphon regulator 38, an anti-siphon valve 39, and an anti-siphon seal 41 to avoid the siphoning of chemical product from the container into the main water supply upstream of the garden hose. A ball valve 42 (FIG. 4) is mounted within tubular portion 32 by a support and control assembly 43 having a rod 44 of rectangular cross-section to a which a control handle 45 is mounted. A locking collar 46 retains assembly 43 in place.

As shown in more detailed in FIG. 4, ball valve 42 has a semi-spherical valve surface 47 with a through opening 48. The ball valve has a central substantially rectangular support opening 49 through which rod 44 extends for rotating ball valve 42 about the central axis of the rod between the liquid carrier closed position of FIG. 4 and liquid carrier open position of FIG. 4A, upon the manual turning of control handle 45.

Cylindrical portion 32 of the housing defines a carrier liquid inlet passage 51 at the inlet end of the housing. And, within tubular portion 32 is mounted an elongated venturi tube 52 capable of free rotation about its longitudinal axis and defines a liquid duct 53 extending between its opposite ends. A portion of the duct necks down as at 54 and then enlarges at juncture 55 for aspirating product through venturi action into the flow of carrier liquid through the duct as will be explained more fully hereinafter. The venturi tube has an outer shoulder at its upstream end which bears against an inner shoulder 56 of housing portion 32 for preventing any relative axial movement of tube 52. And, spherical surface 47 of ball valve 42 bears sealingly against a seal ring 57 mounted at the upstream end of tube 52 providing a tight seal in the FIG. 4 closed position. It is to be pointed out that ball valve 42 and seal 57 against which it seats can be substituted by other types of manually controllable shutoff valves known in the art, without departing from the invention.

Figure 1:
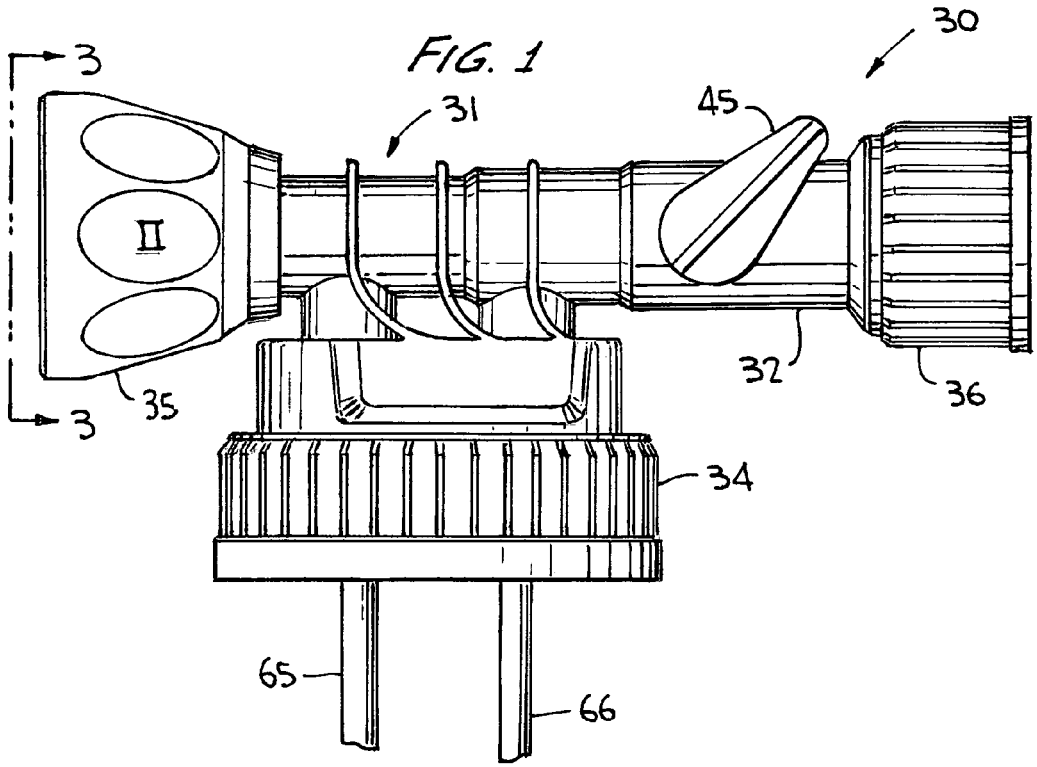
FIG. 1 is a side elevational view of the hose-end sprayer assembly according to the invention.
Figure 2:
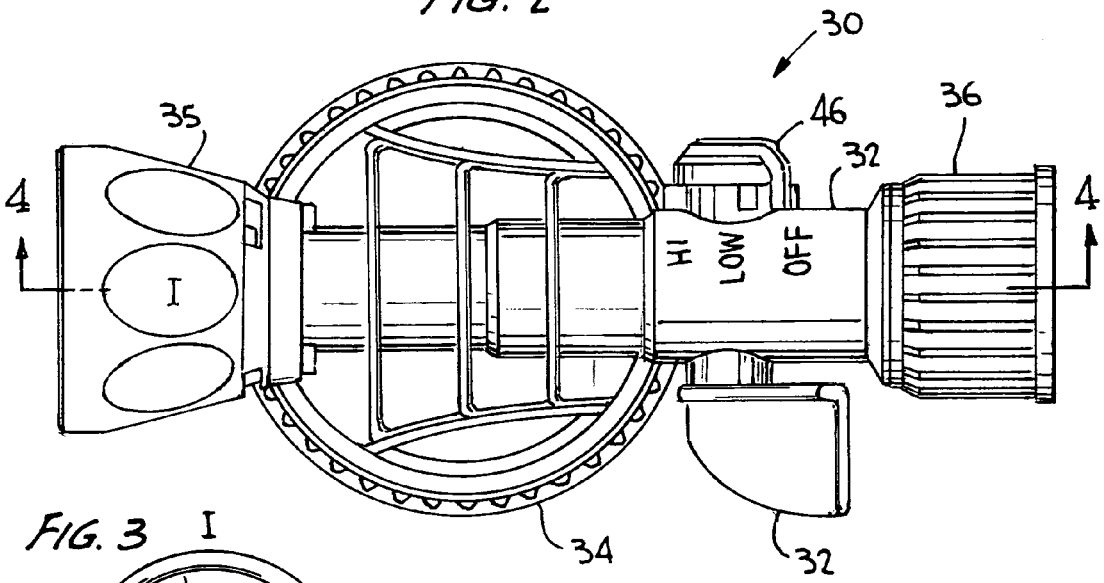
FIG. 2 is a top plan view of the sprayer assembly of FIG. 1.
Figure 3:
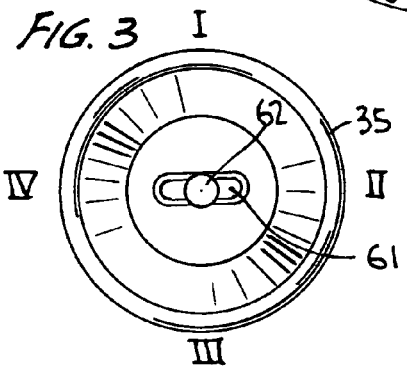
FIG. 3 is a front view of the flow regulator as part of the sprayer assembly, taken substantially along the line 3—3 of FIG. 1.

Keyed to venturi tube 52 for rotation about its central axis together therewith is a diverter tube 58 in surrounding relation which functions as a rotary valve. And, selector grip 35 has an inner sleeve 59 which is keyed to venturi tube 52 for rotation thereof about its central longitudinal axis upon manual rotation of grip 35 between settings I, II, III and IV (FIG. 3). The cup-shaped grip 35 may have an elongated outlet port 61 to effect a fan-shaped spray in the "on" position of the sprayer. And, as shown in FIG. 3, a central portion of opening 61 may be occupied by a pintle 62 or the like to facilitate spreading of the spray discharge.

The sprayer housing, as shown in FIG. 4, has a first liquid product inlet opening 63 in communication with a dip tube 65, and the housing has a second liquid product inlet opening 64 in communication with a dip tube 66.

The housing further has vent ports 69 and 71 respectively associated with inlet openings 63 and 64. The hose end sprayer assembly of the invention is mounted on container C which may have a vertical partition 68 separating the container into two chambers respectively for storing a chemical product A and a chemical product B. Otherwise, the chambers for products A and B may be formed by separate container halves, coupled together by threaded closure 34. Dip tubes 65 and 66 are suspended from bottle mount 33 of the housing via caps 67, 67A and respectively extend into products A and B in the container chambers. Or, the container may form a single chamber for a single product without departing from the invention.

Diverter tube 58, which is shown as a separate part keyed to venturi tube 52 for rotation together therewith, can otherwise be integrally formed with the venturi tube without departing from the invention. In any event, tube 58 controls the inletting of the chemical product or products into the carrier liquid flow path of inlet duct 53 and, likewise controls the opening and closing of the associated vent ports. For this purpose, tube 58 may be provided with a plurality of external rings and/or external pads along its axis, as in FIG. 14. As shown in more detail, FIGS. 5, 6 and 14, tube 58 has an external ring or annulus 70 positioned to overlie product inlet port 63, the annulus having a cutout 60 which, in the FIG. 5, 6 position, uncovers inlet port 63 permitting evacuation of product A by aspirating that product into the carrier liquid flow passage along duct 53 via annular gap 72 between the housing and tube 58, and aligned ports 73 and 74 (FIG. 7), respectively located in diverter tube 58 and in venturi tube 52.

Figures 5, 6, 7, 8, 9, 9A:
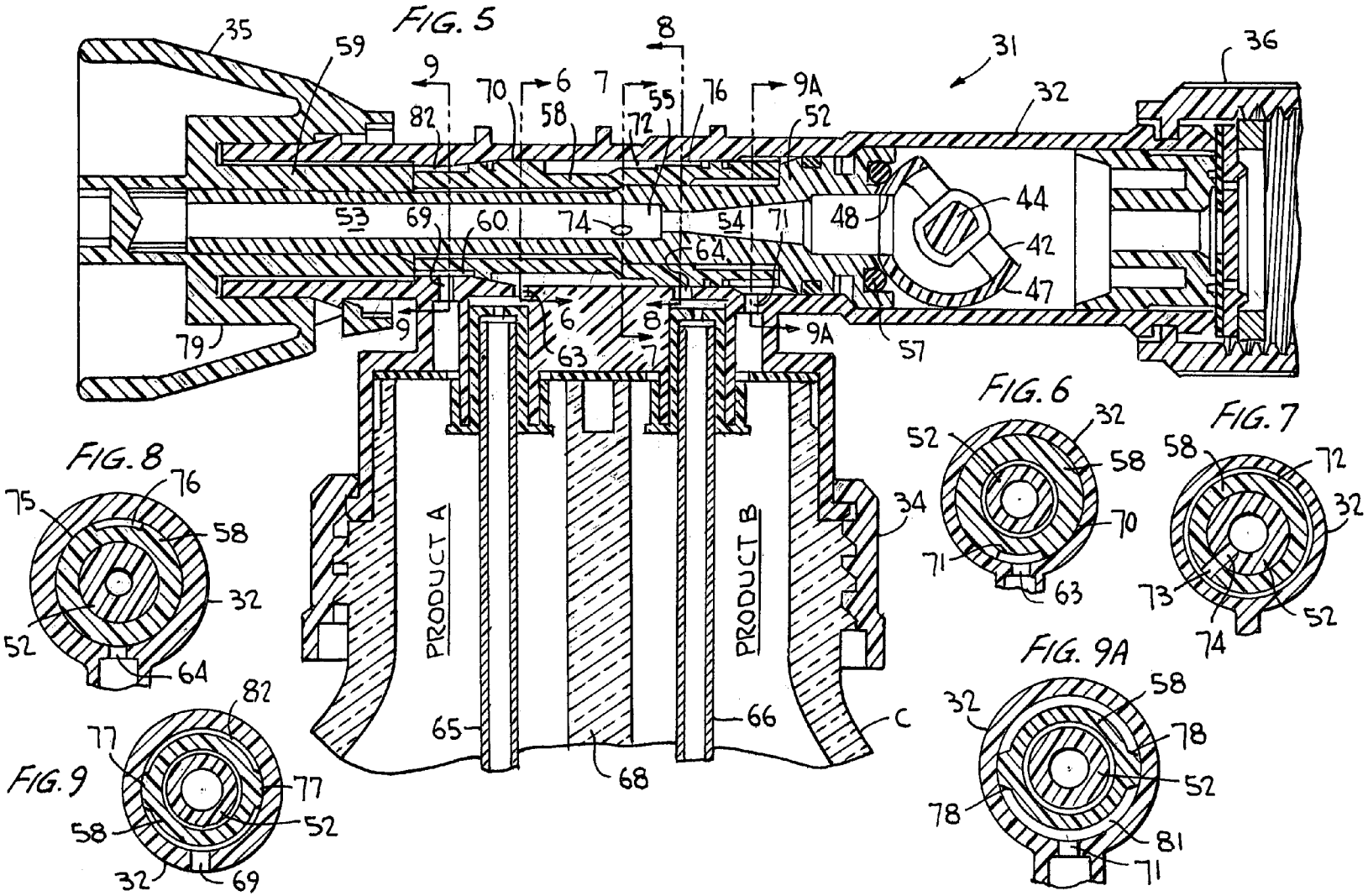
FIG. 5 is a view similar to FIG. 4 showing a sprayer assembly set for the evacuation of product A.
FIGS. 6, 7, 8, 9 and 9A are sectional views respectively taken substantially along the lines 6—6, 7—7, 8—8, 9—9 and 9A—9A of FIG. 5.

Tube valve 58 likewise has a similar ring or annulus 75, shown most clearly in FIGS. 8 and 14, which overlies inlet port 64 for blocking that inlet port in the FIG. 5 condition of the sprayer. Annulus 75 has a cutout 76 (FIGS. 10, 11) such that in the FIG. 10 condition of the sprayer the product inlet 64 is uncovered permitting evacuation of product B via aspiration into the carrier liquid flow path along duct 53 through aligned ports 73 and 74.

Tube 58 likewise has a pair of opposed pads or projections 77 located in a plane intersecting with vent port 69 (FIGS. 9, 14) for blocking the vent port in the FIG. 4 "off" condition and in the FIG. 4A "water only" condition of the sprayer. And, tube 58 has a similar pair of pads or projections of 78 located in a plane intersecting with vent port 71 for blocking that vent port in the FIG. 4 and FIG. 4A conditions of the sprayer. It is to be noted that in both the FIGS. 5 and 10 open positions of the sprayer, the vent control pads are rotated away from the respective vent ports to maintain them both open during the evacuation of product A and likewise during the evacuation of product B.

In operation, hose end sprayer 30 is coupled to the end of a hose by hose closure 36, and is coupled to a container such as C by closure ring 34. The operation will be described for the evacuation of product A and product B, typically disparate chemical products such as for those to be used for hard surface applications or for yard and garden applications, although it is to be pointed out that the hose-end sprayer operates similarly should container C contain but a single chemical product. And, although container C is shown as having a vertical partition wall 68 defining separate chambers for products A and B, it is to be pointed out that a pair of container halves can likewise be used for the respective products A and B, without departing from the invention.

A shown in FIG. 4, ball valve 47 is in its off position such that its semi-spherical surface 47 is in sealing engagement with seal ring 57 along the entire periphery of the seal. In the "off" position of FIG. 4, vent pads 77 and 78 are in a position closing the respective vent ports 69 and 71, and rings 69 and 75 on tube 58 overlie their respective product inlet ports 63 and 64 for the closing of same. The sprayer is in the FIG. 4 "off" position typically during shipping and storage to avoid any leakage of product through open vent ports or through open product inlet ports. In this position, the setting of selector grip 35 is in position I. From this condition of the sprayer, the operator simply turns handle 32 from its OFF position of FIG. 2 to the LOW or HI positions which rotates the ball valve 42 into the open position of FIG. 4A which is shown in the HI position. In the LO position opening 48 would not be fully axially aligned with venturi tube 52, but would rather only be partially aligned therewith. In the FIG. 4A open position, the carrier liquid then simply flows through duct 53 for discharge through outlet port 61 without aspiration of any chemical. In rotative position II of grip 35, the sprayer is in a condition shown in FIG. 5 in which both vent ports are open and the first product inlet port 63 is open such that with ball valve 42 in its open position, carrier liquid flows through reduced section 54 of the venturi tube, expands at section 55 of the duct creating a negative pressure condition which causes product A to be aspirated from its container up through dip tube 65 and through product inlet port 63 and along annular gap 72 into the stream of the flowing carrier liquid via aligned ports 73 and 74. And, as shown in FIG. 9, vent port 69, which communicates with the product A chamber of the container, is uncovered as the pads 77 are in positions not aligned with the vent port 69. The interior of the container of product A is plus thus placed in communication with atmosphere via open vent port 69, the annular gap between the outer diameter of sleeve 59 and the inter diameter of housing cylindrical portion 32, and the annular gap between the outer diameter of cylinder 32 of the housing and the inter diameter of cylindrical wall 79 of selector grip 35. And, in the FIG. 5 condition of the sprayer, annulus 75 overlies product inlet port 64 for sealing that port closed, also shown in FIG. 8, while vent port 71 leading into the container of product B remains open as pads 78 (FIG. 9A) are out of alignment with port 71. The container of product B, therefore, remains open to atmosphere via gap 81 (FIG. 9A), the gap between the inner diameter of tube 58 and the outer diameter of venturi tube 52, and the two annular gaps described above with respect to establishing the vent path for the vent port 69.

Figures 10, 11, 12, 13:
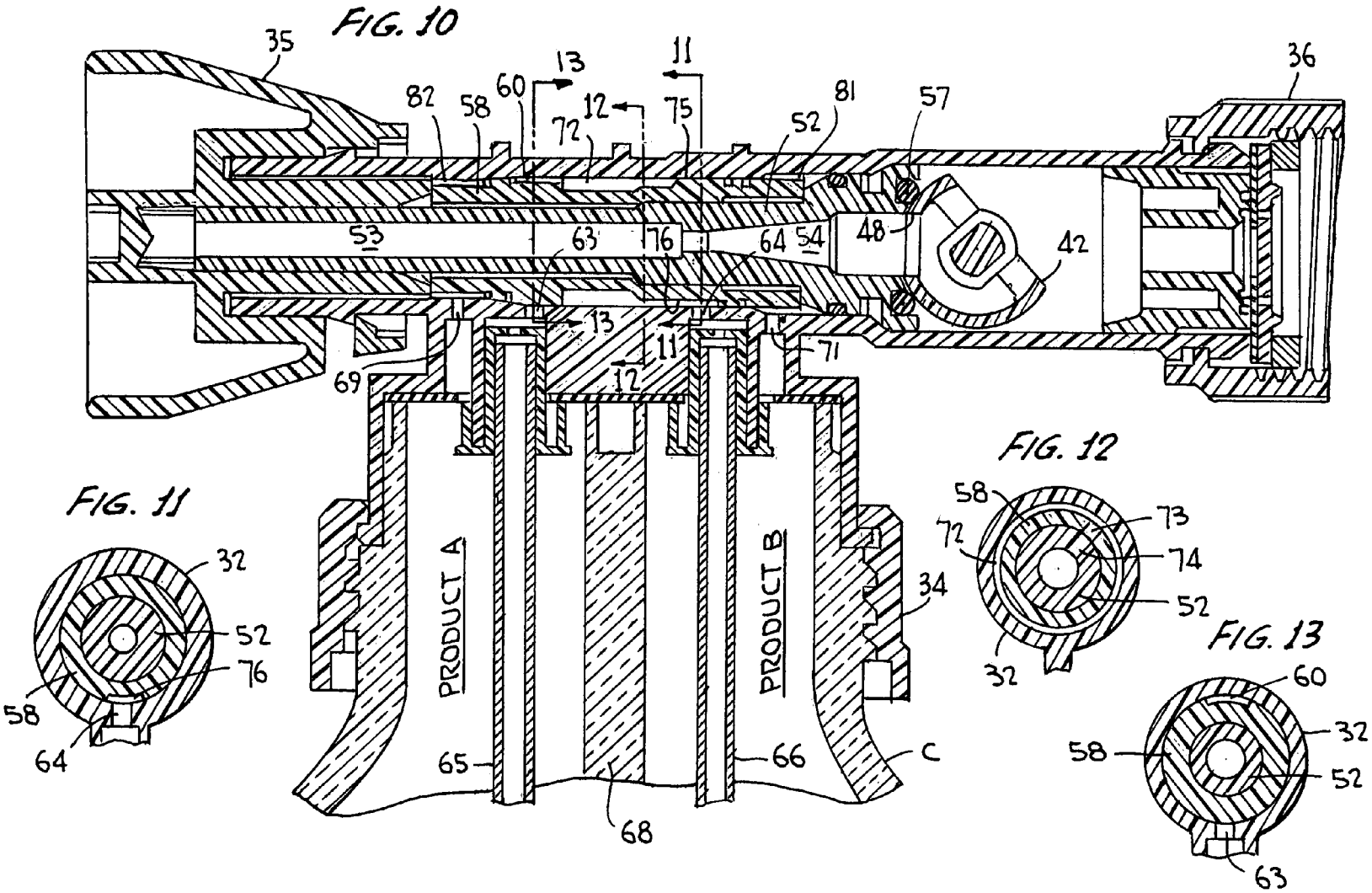
FIG. 10 is a view similar to FIG. 5 but with the sprayer assembly set for the evacuation of product B.
FIGS. 11, 12, and 13 are sectional views respectively taken substantially along the lines 11—11, 12—12, and 13—13 of FIG. 10.

Manual rotation of selector grip 35 to the IV (FIG. 3) setting, for example, which is 180 degrees from the II setting described above, places pads 77 and 78, respectively associated with vent ports 69 and 71 in positions which not overlie their vent ports, as evident by gaps 82 and 81 visible in FIG. 10. In this spray condition, annulus 69 overlies product inlet port 63 for closing same, and cutout 76 overlies product inlet port 64 (FIG. 11) such that product B is aspirated into the path of the carrier liquid flowing through duct 53 via aligned ports 73 and 74 (FIG. 12). Of course, in both the FIGS. 5 and 10 conditions of the sprayer for respectively aspirating product A and product B separately into the flow of the carrier liquid, the independently controlled water supply switch or valve 42 must be rotated into its open position as shown in FIGS. 5 and 10 which is the HI setting. The independently controlled water valve 42 can likewise be set in the LOW position in which opening 48 is slightly out of alignment with the axis of the venturi tube thus impeding the full flow of liquid carrier through the venturi tube.

The sprayer according to the invention, as aforedescribed, is capable of alternatively selecting product A or product B to be aspirated into the flow of carrier liquid through duct 53 on setting the selector grip 35 respectively at positions II and IV. In the other two settings I and III, both product inlet openings as well as their respective vent ports are closed, such that, when the sprayer is coupled to the end of a hose, with the independently operated valve 42 placed in one of its "on" positions, the carrier liquid flows through duct 53 and discharges through outlet port 61 in a "water only" mode. And, in the I and III settings, with the sprayer uncoupled from the end of the hose and ball valve 42 in its closed position, the sprayer assembly is in a shipping and storage position.

Figures 21, 22, 23:
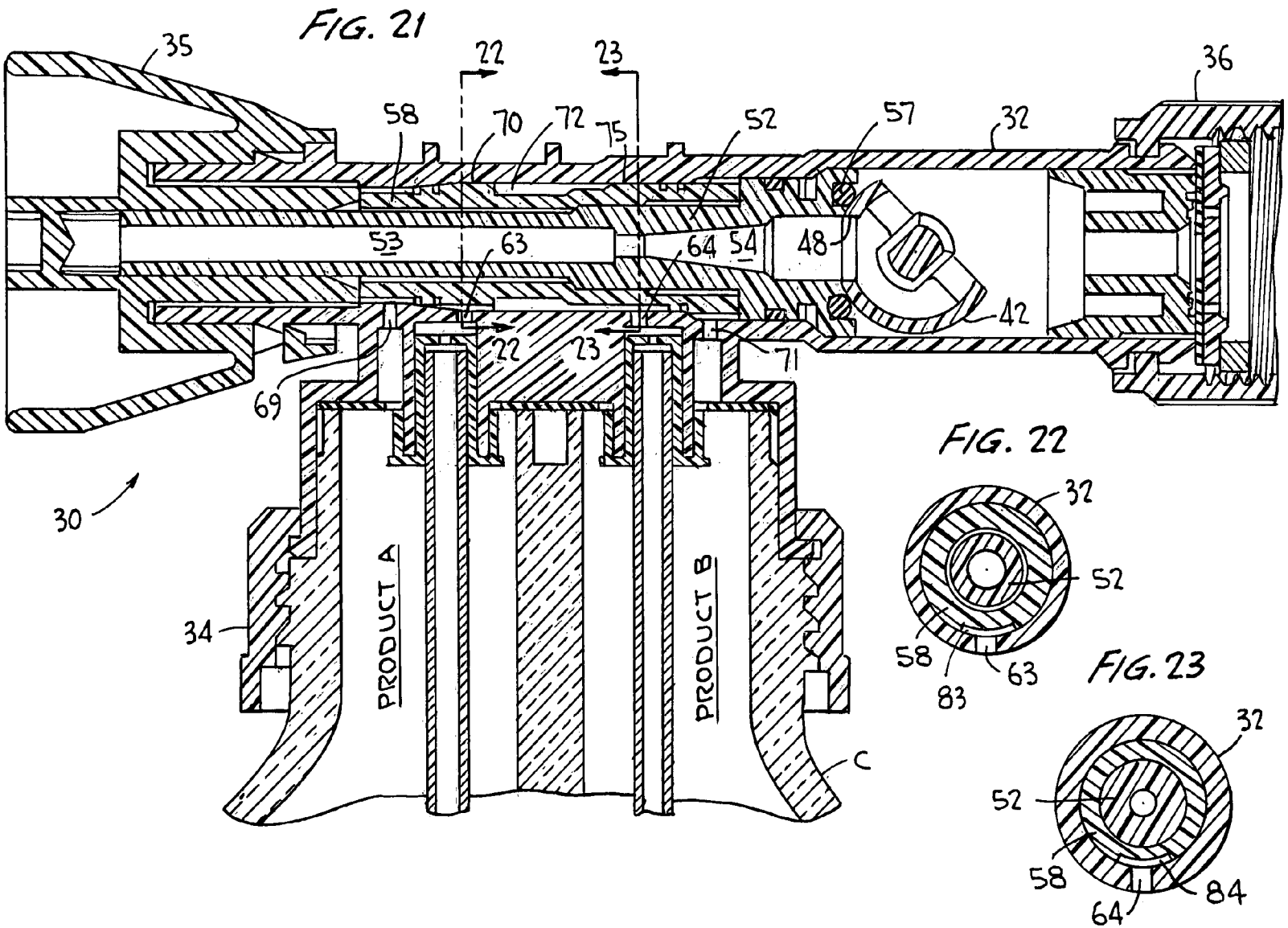
FIG. 21 is a sectional view similar to FIG. 10 showing the sprayer assembly set for the evacuation of products A and B simultaneously.
FIGS. 22 and 23 are sectional views respectively taken substantially along lines 22—22 and 23—23 of FIG. 21.

Further in accordance with the invention, the cutout in annulus 69 for product inlet port 63 and the cutout in annulus 75 for product inlet port 64, can be synchronized or arranged in phase, as shown in FIGS. 21, 22, 23. Thus, cutout 83 in annulus 69 overlies product inlet port 63, and cutout 84 in annulus 75 overlies product inlet port 64 for opening both product inlet ports permitting both products to be aspirated simultaneously and to be mixed together in annular gap 72 before being suctioned into the carrier liquid flow path in duct 53 via aligned ports 73 and 74. The simultaneous/mixing setting may be either setting II or setting IV, with settings I and III being rinse or carrier liquid only settings as with the foregoing embodiment. The hose-end sprayer assembly embodiment of FIGS. 21–23 is likewise useful for the dispensing of a mixture of chemical liquid products in lawn and garden applications and for hard surface applications as well.

From the foregoing, it can be seen that a hose-end sprayer assembly has been devised which is easy to operate, has few parts which renders it economical to produce and assemble, and is versatile in that it can be simply adapted for the aspiration of a single chemical product, two chemical products in alternative settings, and two chemical products in the same setting simultaneously, simply by substituting a single part, namely, diverter tube 58. Otherwise, if the tube 58 is integral with venturi tube 52, then only such a part requires substitution to accommodate the various options.

The venturi tube assembly is rotable about its central longitudinal axis for controlling the opening and closing of the product inlet opening or openings. Rotary movement is effected by the provision of a selector grip which may be cup-shaped and is easily grasped by the operator at the nozzle end of the sprayer. An independently controlled carrier liquid flow valve is provided such that the selector grip 35 at the discharge end of the sprayer assembly does not and cannot control the on and off setting of the carrier liquid flow itself.

Although external pads are shown on the diverter tube for controlling the opening and closing of the vent ports, rings with cutouts could otherwise be provided, or other known external means on tube 58 could be provided for vent control, without departing from the invention. Likewise, external pads defining gaps can replace rings with cutouts for controlling the opening and closing of the product inlet openings, or other known means, within the scope of the invention.

And, other known liquid carrier shutoff valves can replace ball valve 42 without altering the scope of the invention. Obviously, many other modifications and variations of the present invention are made possible in the light of the above teachings. It is therefore to be understood that within the scope of the appended claims the invention may be practiced otherwise than as specifically described.

What is claimed as:

1. A hose-end sprayer assembly for connection to at least one container having a first product chamber for holding product to be dispensed comprising: an elongated housing having a carrier liquid inlet passage, a first liquid product inlet opening and a first vent port both in communication with the first product chamber; rotary product flow diverter means mounted within said housing and coaxial therewith for selective rotation about a central axis thereof and having a liquid duct extending along said axis between inlet and outlet ends thereof, said diverter means having liquid product inlet port in communication with said liquid duct; said diverter means being configured to block said first liquid product inlet opening from said liquid duct in a first rotative position of said diverter means and to connect said first liquid product inlet opening with said liquid duct in a second rotative position of the diverter means; said diverter means being further configured to open and close the vent port respectively in the second and first rotative positions of the diverter means; and an independently movable liquid carrier control valve selectively operable for interconnecting said carrier liquid inlet passage with said liquid duct and for disconnecting the liquid passage from the liquid duct in a closed position.

2. The hose-end sprayer assembly according to claim 1, wherein said liquid carrier control valve comprises a diverter mounted on said housing for rotation about a transverse axis.

3. The hose-end sprayer according to claim 2, wherein said liquid carrier control valve has a spherical surface bearing against said inlet end of the rotary valve means in the closed position.

4. The hose-end sprayer according to claim 1, further comprising an external member on the housing coupled to said diverter means to effect selective rotation of said diverter means between said first and second rotative positions.

5. The hose-end sprayer according to claim 4, wherein the external member comprises a cup-shaped element at the outlet end of said rotary diverter means.

6. The hose-end sprayer according to claim 5, wherein indicia are provided on said cup-shaped element corresponding to the first and the second rotative positions.

7. The hose-end sprayer according to claim 1, wherein the housing has a second liquid product inlet opening and a second vent port both in communication with a second product chamber of the at least one container, the second product chamber for holding another product to be dispensed, said diverter means being configured to block said second liquid product inlet opening from said liquid duct in a third rotative position of said rotary valve means and to connect said second product inlet opening with said liquid duct in a fourth rotative position of said rotary valve means.

8. The hose-end sprayer according to claim 7, wherein said liquid carrier control valve is configured for interconnecting said carrier liquid inlet passage with said liquid duct in both the third and fourth rotative positions of the diverter means.

9. The hose-end sprayer according to claim 7, further comprising an external member on the housing coupled to said diverter means to effect selective rotation of said diverter means between said first, second, third and fourth rotative positions.

10. The hose-end sprayer according to claim 7, wherein said liquid carrier control valve comprises a cup-shaped element having indicia provided thereon corresponding to the first, second, third and fourth rotative positions.

11. The hose-end sprayer according to claim 1, wherein said diverter means comprises an elongated tubular member extending between said inlet and outlet ends and defining said liquid duct.

12. The hose-end sprayer according to claim 11, wherein said diverter means further comprises a hollow tube surrounding said tubular member.

13. The hose-end sprayer according to claim 7, wherein said diverter means is further configured to simultaneously block said first and second product inlet openings from said liquid duct in said first and third rotative positions, and to sequentially connect said first and second product inlet openings respectively in said second and fourth rotative positions.

14. The hose-end sprayer according to claim 1, wherein the housing has a second product inlet opening and a second vent port both in communication with a second product chamber of the at least one container, the second product chamber for holding another product to be dispensed, said diverter means being further configured to simultaneously block said first and second liquid product inlet openings in said first rotative position, and to simultaneously connect said first and second liquid product openings with said liquid duct in said second rotative position.

15. The hose-end sprayer according to claim 7, wherein said diverter means is further configured to simultaneously open said first and second vent ports in said second and fourth rotative positions, and to simultaneously close said first and second vent ports in said first and third rotative positions.

16. The hose-end sprayer according to claim 13, wherein said diverter means is further configured to simultaneously open said first and second vent ports in said second and fourth rotative positions, and to simultaneously close said first and second vent ports in said first and third rotative positions.

17. The hose-end sprayer according to claim 14, wherein said diverter is further configured to simultaneously open said first and second vent ports in said second rotative position, and to simultaneously close said first and second vent ports in said first rotative position.

18. The hose-end sprayer according to claim 14, further comprising an external member on the housing coupled to said diverter means to effect selective rotation of said diverter means between said first and second rotative positions.

19. The hose-end sprayer according to claim 7, wherein said diverter means comprises a hollow tube having a pair of annular rings having surfaces respectively overlying said first and second product inlet openings in said first and third rotative positions, and having cutouts respectively overlying said first and second product inlet openings in said second and fourth rotative positions.

20. The hose-end sprayer according to claim 7, wherein said diverter means comprises a hollow tube having axially spaced apart pads simultaneously overlying said first and second vent ports in said second and fourth rotative positions.

21. A sprayer assembly for connection to a container having at least a first product chamber for holding product to be dispensed, comprising: a tubular housing having a carrier liquid inlet passage for communication with a source of carrier liquid, the housing having a first liquid product inlet opening and a first vent port both in communication with the first product chamber; a tubular valve rotatable about its central axis coaxial with and contained within the housing, the valve defining a liquid duct in communication with said carrier liquid inlet passage, the valve having a liquid product inlet port opening into said liquid duct; said valve being rotatable between at least first and second positions and being configured such that in said first and second positions said liquid product inlet opening is respectively blocked from and connected with said liquid duct and said vent port is respectively closed and opened; and a liquid carrier control valve for opening and closing said carrier liquid inlet passage to said liquid duct.

22. A sprayer assembly for connection to first and second chambers for holding products to be dispensed, comprising: a tubular housing having a carrier liquid inlet passage for connection with a source of cater liquid, the housing having a first liquid product inlet opening and a first vent port both in communication with the first chamber, and a second liquid product inlet opening and a second vent port both in communication with the second chamber; the housing containing a coaxial, tubular valve defining a liquid duct in communication with said carrier liquid inlet passage; said valve being configured to block said first and second liquid product openings from said liquid duct in at least one first position first and third positions of the valve, to connect at least one of said first and second liquid product inlet openings with said liquid duct in at least one second position of the valve, to close the first and second vent ports in the at least one first position of the valve, and to open at least one of the first and second vent ports in the at least one second position of the valve; and a movable liquid carrier control valve for opening and closing said carrier liquid inlet passage to said liquid duct.

23. The sprayer according to claim 21, further comprising a manually operable external member coupled to said tubular valve for movement thereof between said first and second positions.

24. The sprayer according to claim 22, further comprising a manually operable external member coupled to said tubular valve for movement thereof between said at least one first position and said at least one second position of the valve.

25. The sprayer according to claims 23 or 24, wherein said member comprises a grip supporting a spray nozzle at an outlet end of the tubular valve at an outlet end thereof.

26. The sprayer according to claim 25, wherein the grip comprises a cup-shaped element containing indicia corresponding to the positions of movement of the tubular valve.

27. The sprayer according to claim 21, wherein the housing has a second product inlet opening and a second vent port both in communication with a second chamber of the container, the second chamber for holding another product to be dispensed, said tubular valve being further configured to simultaneously block said first and second product inlet openings from said liquid duct in said first and third rotative positions of the valve, and to sequentially connect said first and second product inlet openings respectively with said liquid duct in said second and fourth rotative positions of the valve.

28. The sprayer according to claim 21, wherein the housing has a second product inlet opening and a second vent port in communication both in communication with a second chamber of the container, the second chamber for holding another product to be dispensed, said tubular valve being further configured to simultaneously block said first and second liquid product inlet openings from said liquid duct in said first position, and to simultaneously connect said first and second liquid product inlet openings with said liquid duct in said second position.

29. The sprayer according to claim 27, wherein said tubular valve is further configured to simultaneously open said first and second vent ports in said second and fourth positions, and to simultaneously close said first and second vent ports in said first and third positions.

30. The sprayer according to claim 28, wherein said tubular valve is further configured to simultaneously close said first and second vent ports in said first position, and to simultaneously open said first and second vent ports in said second position.

31. The sprayer according to claim 29, wherein said tubular valve has inlet control pads thereon simultaneously overlying said first and second product inlet openings in said first and third positions, respectively, and has vent control pads thereon simultaneously overlying said first and second vent ports in said first and third positions, respectively.

32. The sprayer according to claim 30, wherein said tubular valve has inlet control pads thereon simultaneously overlying said first and second product inlet openings in said first position, and has vent control pads thereon simultaneously overlying said first and second vent ports in said first position.

* * * * *